United States Patent [19]

Buchser

[11] Patent Number: 4,776,178

[45] Date of Patent: Oct. 11, 1988

[54] THERMOSTAT MOUNTING SYSTEM FOR AUTOMATIC DEFROST REFRIGERATOR

[75] Inventor: William J. Buchser, Marrs Township, Ind.

[73] Assignee: Whirlpool Corporation, Benton Harbor, Mich.

[21] Appl. No.: 115,207

[22] Filed: Nov. 2, 1987

[51] Int. Cl.[4] ..... F25D 21/08

[52] U.S. Cl. ..... 62/156; 200/295; 248/316.7; 403/326

[58] Field of Search ..... 62/156; 248/316.7, 505, 248/510; 403/326, 329, 397; 361/417–420; 200/294, 295

[56] References Cited

U.S. PATENT DOCUMENTS

| | | | |
|---|---|---|---|
| Re. 26,157 | 2/1967 | Tinnerman | 248/361 |
| 1,579,986 | 4/1926 | White | 337/327 |
| 2,321,161 | 6/1943 | Sickles | 220/55 |
| 2,673,334 | 10/1951 | Julian et al. | 339/75 |
| 2,697,579 | 12/1954 | Whitby | 248/361 |
| 2,803,416 | 8/1957 | Berlien | 248/26 |
| 2,867,093 | 1/1959 | Simmons | 62/152 |
| 2,873,082 | 2/1959 | Gillespie | 248/300 |
| 3,131,896 | 5/1964 | Ingraham | 248/27 |
| 3,135,490 | 6/1964 | Kirlin | 248/229 |
| 3,215,873 | 11/1965 | Kruger et al. | 200/295 X |
| 3,849,838 | 11/1974 | Hehl | 361/417 X |
| 3,916,435 | 10/1975 | Camplin et al. | 357/79 |
| 4,176,524 | 12/1979 | Kamiyama et al. | 62/140 |
| 4,206,897 | 6/1980 | Smith et al. | 248/505 |
| 4,235,285 | 11/1980 | Johnson et al. | 165/80 |
| 4,269,035 | 5/1981 | Gelbard | 62/156 X |
| 4,297,668 | 10/1981 | Place | 337/365 |
| 4,446,450 | 5/1984 | Boulanger et al. | 337/343 |
| 4,446,451 | 5/1984 | Boulanger | 337/343 |
| 4,509,839 | 4/1985 | Lavochkin | 357/81 |
| 4,567,390 | 1/1986 | Stewart | 310/68 |
| 4,575,038 | 3/1986 | Moore | 248/505 |

FOREIGN PATENT DOCUMENTS

| | | | |
|---|---|---|---|
| 894142 | 4/1962 | United Kingdom | 248/505 |

*Primary Examiner*—William E. Tapolcai

*Attorney, Agent, or Firm*—Wood, Dalton, Phillips, Mason & Rowe

[57] ABSTRACT

Frostless type refrigerator/freezers having a plastic liner utilize a metal heat shield disposed between an evaporator and the liner. A defrost heater located below the evaporator is controllably energized to melt frost away from the evaporator. A metal clip of spring steel removably mounts a thermostat to the heat shield above the evaporator to sense the temperature above the evaporator to de-energize the heater when the frost is melted from the evaporator.

14 Claims, 2 Drawing Sheets

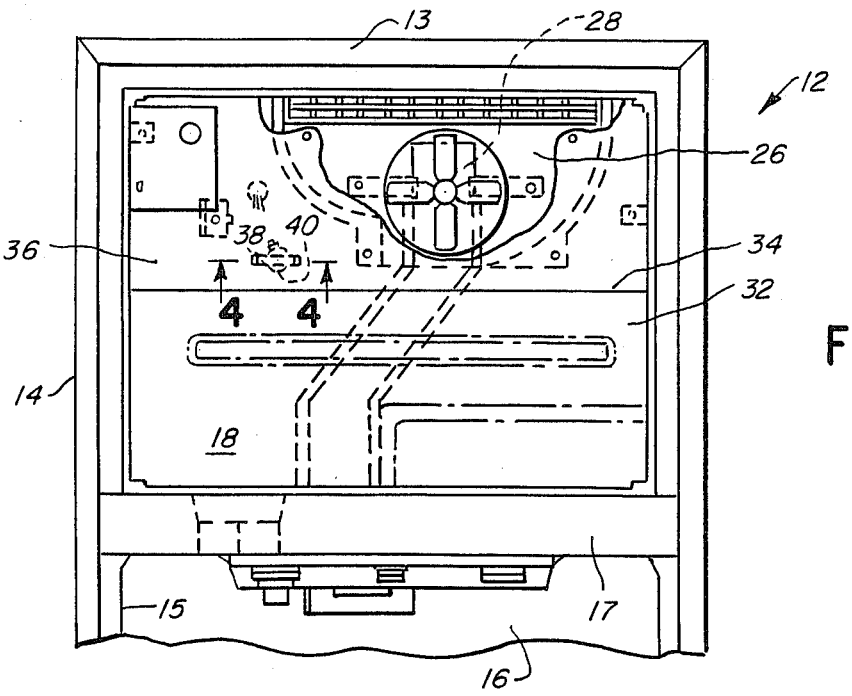
FIG. 3
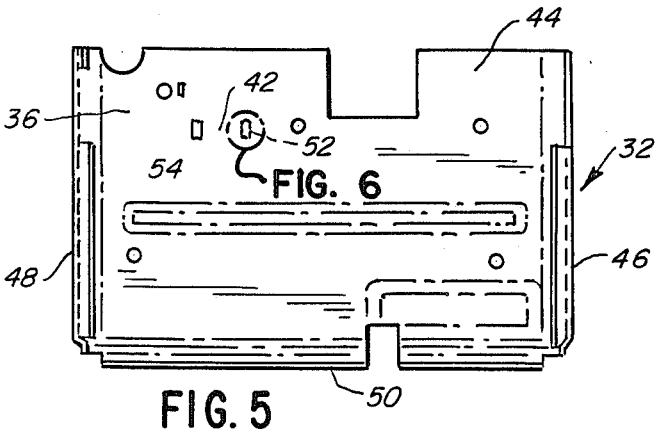
FIG. 6
FIG. 5
FIG. 7
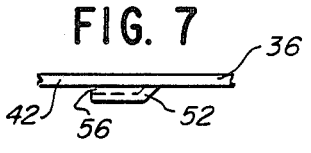
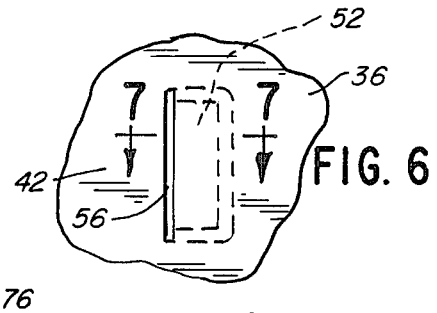
FIG. 6
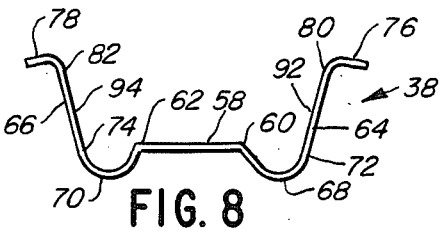
FIG. 8
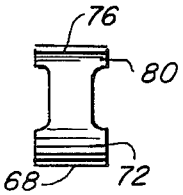
FIG. 9
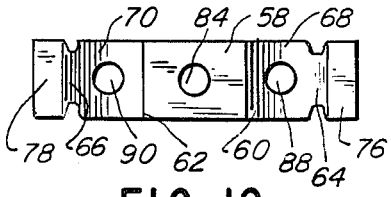
FIG. 10
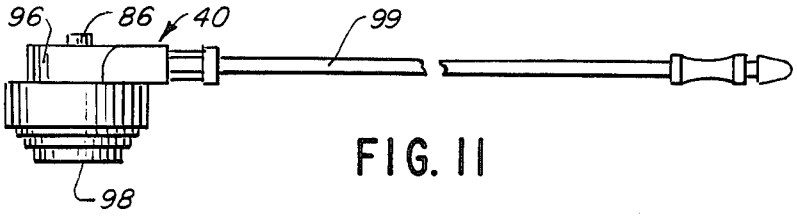
FIG. 11

THERMOSTAT MOUNTING SYSTEM FOR AUTOMATIC DEFROST REFRIGERATOR

BACKGROUND OF THE INVENTION

1. Field of the Invention

This invention relates generally to refrigerators,and more particularly, to an improved thermostat mounting system for automatic defrost refrigerators and the like.

2. Description of Background Art

Conventional frostless or automatic defrost type refrigerator/freezers utilize an electric resistance heater which is energized to melt away frost that accumulates on the coils of an evaporator. The heater may be controllably energized by, for example, a frost sensor or a timer. Once the frost has melted, it is necessary to de-energize the heater. A thermostat, such as a bimetal sensor, is typically utilized for de-energizing the heater according to the sensed temperature. Therefore, the thermostat should be positioned so as to insure that all or most of the frost has been melted away prior to de-energizing the heater.

One location for mounting a defrost thermostat is on one of the coils of the evaporator. A mounting bracket for such an installation is illustrated in Place U.S. Pat. No. 4,297,668. However, due to the coil being of curved cross section there is a limited surface contact area between the thermostat and the coil. Also, due to varying amounts of refrigerant at different positions in the evaporator coil, and the fact that the heater may not melt the frost uniformly across the coil, problems result from the use of such a mounting system. Particularly, while frost may have melted at the particular location of the thermostat, frost may remain elsewhere.

A desirable location for the defrost thermostat is to have it mounted above the evaporator. Refrigerators constructed with plastic liners typically use a metal protective liner, or heat shield, separating the evaporator from the liner. The heat shield is in heat transfer association with the evaporator. It has been proposed that mounting the thermostat to the heat shield, above the evaporator, provides a more representative temperature measurement than having the thermostat mounted to the evaporator coil.

In order for a thermostat mounted to the metal plate to function reliably, the thermostat should be maintained in facial contact with the heat shield. Moreover, it is desirable that installation be simple and achievable at low cost. Also the thermostat should be easily replaceable. Additionally, it is desirable that fasteners, such as screws, are not utilized which would penetrate the plastic liner.

The present invention overcomes the above problems of the prior art refrigerators/freezers in a novel and simple manner.

SUMMARY OF THE INVENTION

In accordance with the present invention, a refrigeration apparatus is provided with a mounting apparatus adapted to urge a defrost thermostat in facial contact with a metal shield in heat transfer association with an evaporator.

Broadly, there is disclosed herein a refrigeration apparatus having an outer shell, an inner liner spaced inwardly from the shell, an evaporator and a defrost heater. Means are included for mounting the evaporator and the defrost heater inwardly from the liner in heat transfer relation. A thermostat includes a switch for controllably de-energizing the defrost heater. A mounting apparatus for the thermostat comprises a metal shield in heat transfer association with the evaporator. The shield includes a top portion which extends upwardly relative to the evaporator having a substantially flat surface portion and a pair of opposed raised sockets.

A body of spring steel includes a central portion for engaging the thermostat. The central portion defines opposite ends. First and second side portions are included on the body each having a length preselected to space the central portion away from the shield less than the height of the thermostat. The spacing between the side portions is sufficient to permit inward movement of the side portions when the thermostat is disposed therebetween. First and second resiliently yieldable connecting portions connect the opposite ends of the central portion to upper ends of the first and second side portions. First and second tabs are turned outwardly from the lower ends of the side portions. The tabs are received in the sockets to cause the central portion to act downwardly on the thermostat and resiliently urge the thermostat in facial contact with the flat surface portion of the top portion of the shield. The tabs extend outwardly sufficiently to remain in the sockets when the thermostat causes the central portion to be under tension and thereby cause the connecting portions to resiliently urge the side portions inwardly.

It is another object of the present invention to provide a mounting apparatus which provides for ease of installation and replacement of the thermostat.

It is yet another object of the present invention to provide a mounting apparatus adapted to maintain the thermostat in facial contact with the metal shield without the use of fasteners.

It is a further object of the present invention to provide a mounting apparatus adapted to enable a thermostat to controllably de-energize the heater after the defrosting of the evaporator is completed.

Further features and advantages of the invention will readily be apparent from the specification and from the drawings.

BRIEF DESCRIPTION OF THE DRAWINGS

FIG. 3 is an enlarged fragmentary front elevational view of the refrigeration apparatus of FIG. 1 with parts cut away;

FIG. 5 is an elevation view of a heat shield of the refrigeration apparatus;

FIG. 6 is an enlarged, perspective view of a raised scoop of the heat shield of FIG. 5;

FIG. 7 is a sectional view taken along line 7—7 of FIG. 6;

FIG. 8 is an elevational view of a spring clip according to the invention;

FIG. 9 is a side view of the spring clip of FIG. 8;

FIG. 10 is a top view of the spring clip of FIG. 8; and

FIG. 11 is an elevational view of a defrost thermostat.

DESCRIPTION OF THE PREFERRED EMBODIMENT

Figure 1:
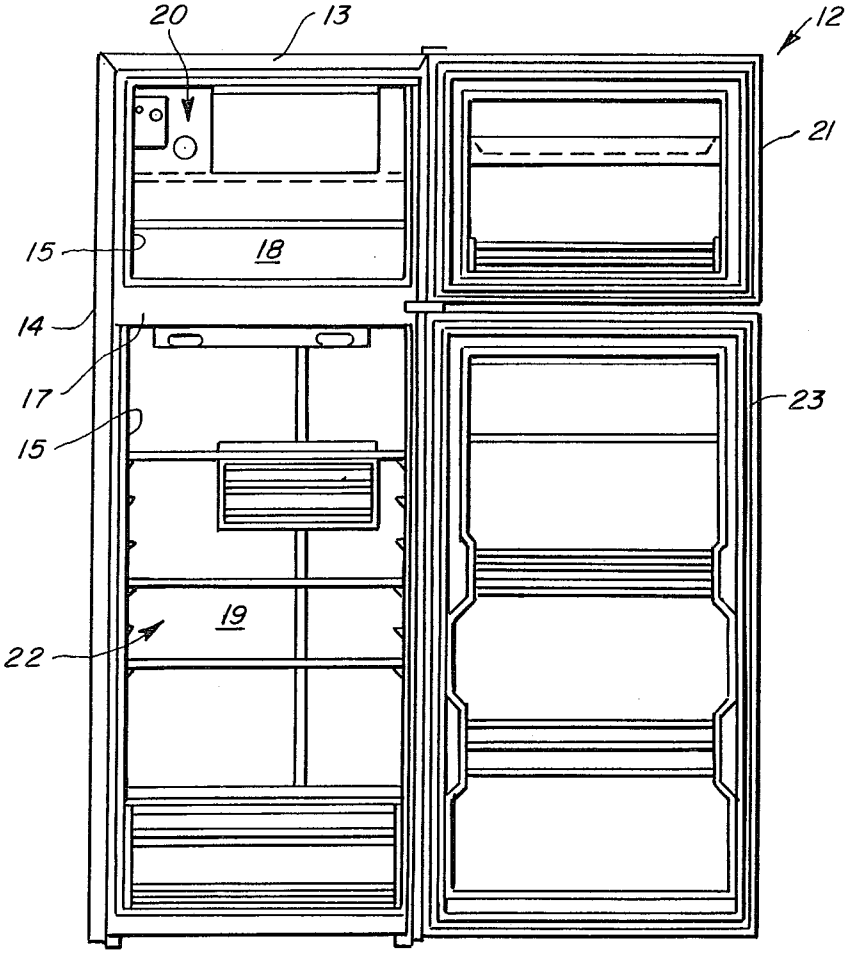
FIG. 1 is a front elevational view of a refrigeration apparatus having a thermostat mounting system embodying the invention.

Referring to FIG. 1, a refrigeration apparatus, such as a refrigerator/freezer, 12 includes a thermostat mounting apparatus according to the present invention. The invention is shown utilized with a refrigerator/freezer; however other types of refrigeration apparatus may be used in conjunction with the mounting apparatus of the present invention, as will be obvious to those skilled in the art.

The refrigerator/freezer 12 includes a cabinet 13 defining an outer shell 14. A liner 15 is spaced inwardly from the shell 14. The liner 15 includes a rear wall 16, see FIG. 2. A partition 17 divides the cabinet 13 into an upper, above freezing, or freezer, compartment 18 and a lower, below freezing, or fresh food, compartment 19. The freezer compartment 18 includes a front opening 20 selectively closed by a freezer door 21. The frest food compartment 19 includes a front opening 22 selectively closed by a second door 23.

Figure 2:
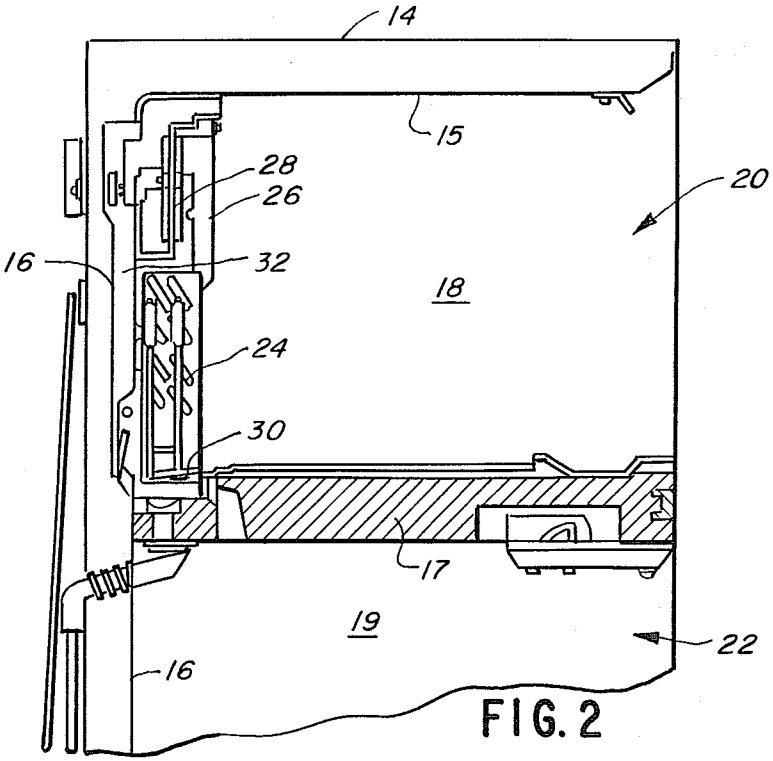
FIG. 2 is a fragmentary side elevational view of the refrigeration apparatus of FIG. 1.

Referring also to FIG. 2, an evaporator 24 is provided in the rear of the freezer compartment 18 forwardly of the rear wall 16 of the liner 15. A metal evaporator cover plate 26 forwardly of the evaporator 24 defines a back wall for the freezer compartment 18. An evaporator fan 28 located above the evaporator 24 draws air across the evaporator 28 to provide refrigerated air for cooling the compartments 18 and 19. A defrost heater 30 is located below the evaporator 24 and is controllably energized by any known means, such as a timer or frost sensor (not shown) to melt away any frost that accumulates on coils of the evaporator 24. A metal heat shield 32 separates the evaporator 24 from the liner 15.

Figure 4:
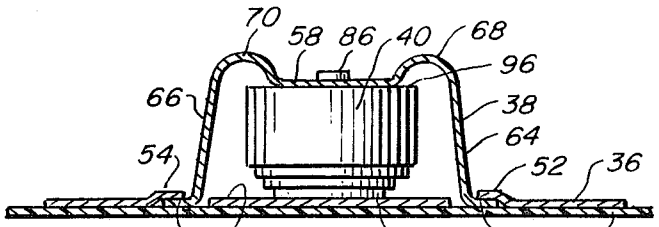
FIG. 4 is a sectional view taken along lines 4—4 of FIG. 3.

Referring to FIG. 3, a line 34 represents the upper level of the evaporator 24, not shown in FIG. 3. The heat shield 32 includes a top portion 36, extending above the line 34. Referring also to FIG. 4, a spring clip 38 removably mounts a thermostat 40 in facial contact with a flat surface portion 42 of the heat shield top portion 36. The thermostat 40 is a bimetal device including a switch. The switch breaks an electric circuit to the heater 30 to de-energize the heater when the temperature sensed is at a preselected level to indicate that the evaporator 24 has been sufficiently defrosted. Heat from the defrost heater 30 is conducted upwardly through the evaporator 24. The heat shield 32 is in heat transfer association with the evaporator 24. The thermostat 40 is in heat transfer association with the heat shield top portion 36, above the evaporator 24. Accordingly, the thermostat 40 senses the temperature of the conducted heat only after it has been conducted through the evaporator 24. The temperature sensed by the thermostat 40 accurately reflects the temperature across the entire evaporator 24 to indicate when the evaporator 24 is sufficiently defrosted.

Referring to FIG. 5, the heat shield 32 includes a back wall 44, forwardly turned side walls 46 and 48, and a forwardly turned bottom wall 50. As described above, the evaporator 24 is mounted forwardly of the heat shield rear wall 44 with its side and bottom surrounded by respective side and bottom walls 46, 48 and 50 of the heat shield 32.

Referring also to FIGS. 6 and 7, a pair of opposed raised sockets 52 and 54 are located on either side of the flat surface portion 42 of the heat shield back wall 44. The sockets 52 and 54 are formed in the heat shield 32 and extend forwardly therefrom. Each socket 52 and 54 defines an elongated opening 56 for receivng the spring clip 38, as is discussed in greater detail below. The sockets 52 and 54 are substantially rectangular in shape.

Referrring to FIGS. 8–11, the spring clip 38 comprises a body of spring steel. The spring clip 38 includes a central portion 58 for engaging the thermostat 40. The central portion 58 defines opposite ends 60 and 62. First and second side portions 64 and 66 each have a length preselected to space the central portion 58 away from the heat shield flat surface portion 42 less than the height H of the thermostat 40. The spacing between the side portions 64 and 66 is sufficient to permit inward movement of the side portions 64 and 66 when the thermostat 40 is disposed therebetween in engagement with the central portion 58.

The spring clip 38 further includes resiliently yieldable, arcuately shaped connecting portions 68 and 70. The connecting portions 68 and 70 connect the central portion opposite ends 60 and 62 to upper ends 72 and 74 of the side portions 64 and 66, respectively. First and second tabs 76 and 78 are turned outwardly from lower ends 80 and 82 of the side portions 64 and 66, respectively. An aperture 84 is centrally located in the central portion 58 for snugly receiving an extending tab 86 on the thermostat 40, see FIGS. 4 and 11. The aperture 84 is sized to provide a friction fit with tab 86 whereby the clip and thermostat are retained in assembled association for facilitated installation thereof onto the heat shield portion 36.

Additional apertures 88 and 90 are provided in the connecting portions 68 and 70, respectively, for permitting greater flexibility of the connecting portions 68 and 70. Similarly, the side portions 64 and 66 are narrower at center portions 92 and 94, respectively, between the respective ends thereof, to weaken the side portions 64 and 66 to provide for additional flexibility.

The thermostat 40 includes a rear wall 96 having the tab 86 extending therefrom, and a sensing wall 98 for contacting a surface at which temperature is to be measured. Suitable conductors 99 are provided for connecting the thermostat to a control circuit, as is obvious to those skilled in the art.

Referring particularly to FIG. 4, the central portion 58 of the clip 38 engages the thermostat rear wall 96 to resiliently urge the thermostat sensing wall 98 in facial contact with the heat shield flat surface portion 42. The sockets 52 and 54 receive the tabs 76 and 78, respectively, of the spring clip 38. The tabs 76 and 78 extend outwardly sufficiently to remain in the sockets 52 and 54 when the thermostat 40 causes the central portion 58 to be under tension and thereby cause the connecting portions 68 and 70 to resiliently urge the side portions 64 and 66 inwardly.

The spring clip 38 according to the present invention maintains the thermostat 40 in facial contact with the heat shield top portion 36 so that the thermostat 40 accurately senses the temperatue of the heat shield above the evaporator temperature.

As will be appreciated by those skilled in the art, the spring clip 38 described herein can be utilized for surface mounting other devices to a wall having a substantially flat surface portion and a pair of opposed raised sockets, as described herein. Accordingly, the invention is not intended to be limited strictly to mounting a thermostat to an evaporator heat shield in a refrigeration apparatus.

Thus, the invention broadly comprehends an improved mounting apparatus for mounting a device in surface contact with a wall having a substantially flat surface portion.

The foregoing disclosure of the preferred embodiment is illustrative of the broad inventive concepts comprehended by the invention.

I claim:

1. In a refrigeration apparatus having an outer shell, an inner liner spaced inwardly from said shell, an evaporator, a defrost heater, means for mounting said evaporator and defrost heater inwardly from said liner in heat transfer relation, and a thermostat having a switch for de-energizing said defrost heater, a thermostat mounting apparatus comprising:

a metal shield in heat transfer association with said evaporator, separating said evaporator and defrost heater from said liner, said shield including a top portion extending upwardly relative to said evaporator having a substantially flat surface portion and a pair of opposed raised sockets;

a body of spring steel including a central portion for engaging said thermostat, said central portion defining opposite ends;

first and second side portions each having a length preselected to space said central portion away from said wall less than the height of said thermostat, the spacing between said side portions being sufficient to permit inward movement of said side portions when said thermostat is disposed therebetween;

first and second resiliently yieldable connecting portions connecting said opposite ends of said central portion to upper ends of said first and second side portions, respectively; and first and second tabs turned outwardly from lower ends of said first and second side portions, respectively, received in said sockets to cause said central portion to act downwardly on said thermostat and resiliently urge the thermostat in facial contact with the flat surface portion of said top portion of said shield, said tabs extending outwardly sufficiently to remain in said sockets when said thermostat causes said central portion to be under tension and thereby cause said connecting portions to resiliently urge said side portions inwardly.

2. The refrigeration apparatus of claim 1 wherein said cental portion includes an aperture for snugly receiving an outwardly extending tab on said thermostat for retaining the thermostat in a desired position relative to said flat surface portion.

3. The refrigeration apparatus of claim 1 wherein said connecting portions include apertures therethrough so as to weaken said connecting portions to provide greater flexibility thereof.

4. The refrigeration apparatus of claim 1 wherein said side portions include midportions between said upper and lower ends thereof which are narrower than said end portions so as to provide greater flexibility of said side portions.

5. The refrigeration apparatus of claim 1 wherein said central portion is substantially of flat rectangular shape.

6. The refrigeration apparatus of claim 1 wherein said connecting portions are substantially arcuately shaped.

7. The refrigeration apparatus of claim 1 wherein said sockets include forwardly extending formed raised portions in said metal shield defining access openings for receiving said tabs.

8. In a refrigeration apparatus including an outer shell, an inner liner spaced inwardly from said shell, an evaporator, a defrost heater for controllably defrosting said evaporator, and a thermostat for de-energizing said defrost heater, a mounting apparatus for said thermostat comprising:

a metal shield separating said evaporator from said liner including a substantially flat surface portion and a pair of opposed, raised sockets;

a body of spring steel including a central portion for engaging said thermostat, said central portion defining opposite ends;

first and second side portions each having a length preselected to space said central portion away from said shield less than the height of said thermostat, the spacing between said side portions being sufficient to permit inward movement of said side portions when said thermostat is disposed therebetween;

first and second resiliently yieldable connecting portions connecting said opposite ends of said central portion to upper ends of said first and second side portions, respectively; and first ad second tabs turned outwardly from lower ends of said first and second side portions, respectively, received in said sockets to cause said central portion to act downwardly on said thermostat and resiliently urge said thermostat in facial contact with the flat surface portion of said shield, said tabs extending outwardly sufficiently to remain in said sockets when said thermostat causes said central portion to be under tension and thereby cause said connecting portions to resiliently urge said side portions inwardly.

9. The refrigeration apparatus of claim 8 wherein said central portion includes an aperture for receiving an outwardly extending tab on said thermostat for retaining the thermostat in a desired position relative to said flat surface portion.

10. The refrigeration apparatus of claim 8 wherein said connecting portions include apertures therethrough so as to weaken said connecting portions to provide greater flexibility thereof.

11. The refrigeration apparatus of claim 8 wherein said side portions include mid portions between said upper and lower ends thereof which are narrower than said end portions so as to provide greater flexibility of said side portions.

12. The refrigeration apparatus of claim 8 wherein said central portion is substantially of flat rectangular shape.

13. The refrigeration apparatus of claim 8 wherein said connecting portions are substantially arcuately shaped.

14. The refrigeration apparatus of claim 8 wherein said sockets include forwardly extending formed raised portions in said metal shield defining access openings for receiving said tabs.

* * * * *